United States Patent [19]

Likhyani

[11] 4,426,420

[45] Jan. 17, 1984

[54] SPUNLACED FABRIC CONTAINING ELASTIC FIBERS

[75] Inventor: Kewal K. Likhyani, Wilmington, Del.

[73] Assignee: E. I. Du Pont de Nemours and Company, Wilmington, Del.

[21] Appl. No.: 419,399

[22] Filed: Sep. 17, 1982

[51] Int. Cl.[3] ..... D04H 5/00

[52] U.S. Cl. ..... 428/224; 28/103; 28/104; 428/227; 428/288; 428/296; 428/299; 428/360

[58] Field of Search ..... 428/288, 296, 360, 227, 428/299, 224; 28/103, 104

[56] References Cited

U.S. PATENT DOCUMENTS

| | | | |
|---|---|---|---|
| 3,007,227 | 11/1961 | Moler | 28/81 |
| 3,485,706 | 12/1969 | Evans | 161/72 |
| 3,493,462 | 2/1970 | Bunting et al. | 161/169 |
| 3,494,821 | 2/1970 | Evans | 161/169 |
| 3,560,326 | 2/1971 | Bunting et al. | 161/169 |
| 3,651,014 | 3/1972 | Witsiepe | 260/75 R |
| 3,763,109 | 10/1973 | Witsiepe | 260/75 R |
| 3,766,146 | 10/1973 | Witsiepe | 260/75 R |
| 4,107,364 | 8/1978 | Sisson | 428/296 |
| 4,209,563 | 6/1980 | Sisson | 428/288 |
| 4,320,166 | 3/1982 | Endo et al. | 428/288 |

FOREIGN PATENT DOCUMENTS

| | | |
|---|---|---|
| 46346 | 2/1982 | European Pat. Off. . |
| 56-118911 | 9/1981 | Japan . |
| 1263822 | 2/1972 | United Kingdom . |

*Primary Examiner*—James J. Bell

[57] ABSTRACT

Novel hydraulically entangled spunlaced fabrics and an improved process for making such fabrics composed of at least two types of staple fibers are provided. Elastomeric staple fibers which behave as ordinary staple fibers until heat treated are included in the hydraulically entangled fabric. Upon heat treatment, the elastomeric fibers become elastic and impart improved stretch and resilience properties to the fabric.

8 Claims, No Drawings

SPUNLACED FABRIC CONTAINING ELASTIC FIBERS

BACKGROUND OF THE INVENTION

1. Field of the Invention

This invention relates to a nonwoven fabric containing a blend of hard and elastic staple fibers. In particular the invention concerns an improved process for making such a fabric in the form of a heat-treated, spunlaced structure which has improved physical and aesthetic characteristics.

2. Description of the Prior Art

Nonwoven fabrics made by hydraulic entanglement techniques are well known in the art, as for example, from U.S. Pat. Nos. 3,485,706 (Evans), 3,493,462 (Bunting et al.), 3,494,821 (Evans) and 3,560,326 (Bunting et al.). These patents disclose the impingement of fine columnar jets of liquid onto a fibrous batt supported on a foraminous member. This treatment entangles the fibers and converts the batt into a strong nonwoven fabric. Adhesive binders or self-bonding fibers are not necessary to hold the fibers together. Such fabrics have been referred to in commercial use, as well as in the technical literature, as spunlaced fabrics.

Fibers suitable for use in the starting batts of these spunlaced fabrics can be of one or more types and compositions. A wide range of fiber lengths is useful, from very short to substantially continuous. The resultant hydraulically entangled fabrics can be nonpatterned or have a repeating pattern of entangled fiber regions and interconnecting fiber regions, with or without a repeating pattern of apertures. It has also been suggested that by combining fibers of different compositions, melting or softening points, deniers, lengths or cross-sections, tactile aesthetics and physical properties of the fabric can be altered.

Many useful spunlaced fabrics have been prepared by the above-described hydraulic entanglement techniques. Numerous blends of different types of fibers have been found suitable for making a wide variety of spunlaced fabrics. Such fabrics have found application in a wide variety of uses and products. However, improvements in the stretch, resilience, crease resistance and other aesthetic characteristics of these fabrics would greatly enhance their utility and versatility. For example, strong, stretchable and resilient nonwoven fabrics are desired as substrates for use in vinyl-coated upholstery mterial. Nonwovens with such improved characteristics also would improve their utility in nonwoven industrial garments and increase their life in limited wear garments. The surface characteristics as well as the stretch, resilience and strength characteristics of spunlaced fabrics are of great importance to synthetic leather manufacturers and improvements in several of these characteristics would improve the usefulness of the substrate, as for example, in the manufacture of synthetic leather gloves, shoe uppers, and bags.

U.S. Pat. No. 3,485,706, Example 56, item "e," illustrates the fabrication of a bulky, puckered, spunlaced fabric having high elasticity in one direction. The structure is made up of two layers of polyester staple fibers, between which is a warp of spandex yarns of 70-denier, coalesced multifilaments. During the hydraulic entanglement step of the fabrication, the spandex yarns are prestretched 200%. The patent further suggests that any elastic fibers and/or yarns may be used in a tensioned warp or cross warp and that any fiber may be used in the surface layers to obtain a warp-reinforced spunlaced nonwoven fabric. Although such structures are technically feasible, the introduction of pretensioned warps into the hydraulic entanglement process results in technical complications and additional costs. Furthermore, well known spandex filaments or yarns which might be used in such fabrics generally are of high denier and lead to irregularities or "show through" of the pretensioned warps in the final product.

U.S. Pat. No. 3,007,227 (Moler) suggests that improved yarns, fabrics and other textile materials can be made with blends of intermingled fibers of staple length comprised of a major portion by weight of hard inelastic staple fibers and a minor portion of essentially straight elastomeric staple fibers. The patent discloses nonwoven fabrics can be made from such blends in the form of carded webs, Rando-Webber batts and mechanically needled felts. A felt made by mechanically needling a 75/25 blend of rabbit fur and synthetic elastomeric fibers is exemplified in Example VIII, wherein the elastic fiber is reported to increase the hardness and compactness of the felt, as well as its resistance to delamination, in comparison to a felt made of 100% rabbit fur.

The purpose of the present invention is to provide an improved process for preparing nonwoven fabrics containing elastic fibers and to provide an improved spunlaced nonwoven fabric thereby.

SUMMARY OF THE INVENTION

The present invention provides an improved process for making a nonwoven fabric. The process is of the general type wherein a batt composed of at least two types of staple fibers is subjected to a hydraulic entanglement treatment to form a spunlaced nonwoven fabric. For the purpose of imparting greater stretch and resilience to the fabric, the process improvement comprises forming the batt of hard fibers and potentially elastic elastomeric fibers and after the hydraulic entanglement treatment, heat-treating the thusly produced fabric to develop elastic characteristics in the elastomeric fibers. The preferred polymer for the elastomeric fibers is poly(butylene terephthalate)-co-poly-(tetramethyleneoxy)terephthalate.

The present invention also includes novel spunlaced nonwoven fabrics made by the above-described process.

DETAILED DESCRIPTION OF PREFERRED EMBODIMENTS

In accordance with this invention, the process requires the basic steps of forming a batt of blended staple fibers, hydraulically entangling the batt fibers to form a spunlaced fabric and heat-treating and spunlaced fabric. Although each of these basic steps is known in the art, the use of these steps with the particular blends of staple fibers required in the present process, is novel and leads to unexpectedly large improvements in various physical and aesthetic characteristics of the final product.

In the first step of the process of the invention, a batt is formed from at least two types of staple fibers; namely, hard fibers and elastomeric fibers that are "potentially elastic." The fibers, which are substantially uniformly intermixed in the batt, may have been blended by conventional methods prior to batt formation or may have been blended in the batt-forming step itself.

The hard fiber may be of any staple length or denier suitable for processing on conventional batt-making equipment, such as cards, Rando-Webbers, or air-lay-down equipment such as that disclosed in U.S. Pat. No. 3,797,074 (Zafiroglu). The hard fibers may be of any synthetic fiber-forming material, such as polyesters, polyamides, acrylic polymers and copolymers, vinyl polymers, cellulose derivatives, glass, and the like, as well as any natural fiber such as cotton, wool, silk, paper, and the like, or a blend of two or more hard fibers. These hard fibers generally have low stretch characteristics as compared to the stretch characteristics of the elastic fibers described hereinafter.

The term "elastic" as used herein has the meaning usually given to that term in the art and is intended herein to describe a fiber that can elongate at least 100% before breaking. When elastic characteristics are developed in the heat-treatment step, the elastomeric fibers suitable for use in the present invention have break elongations of at least 100% and preferably greater than 150%, but usually less than 500%. Generally, these elastic fibers have a modulus of less than about 1 gram per denier and preferably less than about ½ gram per denier. This is in contrast to the hard fibers which generally have a modulus in the range of about 18 to 85 grams per denier and usually elongate no more than about 20 to 40% before breaking.

The term "potentially elastic" refers to the elastomeric fibers in the blend, which have the ability to be handled like hard fibers on conventional batt-making equipment but are capable of exhibiting elastic characteristics upon being subjected to a suitable heat treatment.

The potentially elastic fibers utilized in the staple fiber blends of the present invention are generally made of synthetic elastomeric polymer which has been extruded into filaments, drawn and cut to form staple fibers having a denier in the range of about 1 to about 30 and a staple length of about ½ to about 6 inches. The potentially elastic fibers of the present invention may be selected from several classes of elastomeric polymer compositions, among which are the classes described in column 6, line 70 through column 7, line 56 of U.S. Pat. No. 3,007,227, which portion of text is incorporated herein by reference. A simple test for determining which of such polymers from potentially elastic elastomeric fibers is to spin a candidate polymer into filaments, draw the filaments (e.g., at a draw ratio of at least 2:1), and then measure the tenacity, elongation and modulus before and after a relaxed heat treatment (e.g., of 3 minutes at 150° C.). Comparison of the before and after treatment properties immediately reveals which polymers are suitable for making the elastomeric fibers required by the present invention.

A class of elastomeric compositions which has shown particular utility in the present invention is the polyetheresters and more specifically, poly(butylene terephthalate)-co-poly(tetramethyleneoxy)terephthalates, such as those disclosed in U.S. Pat. Nos. 3,651,014, 3,766,143 and 3,763,109 (Witsiepe). In these polymers, the poly(butylene terephthalate) units comprise the hard segments of the polymer chain and poly(tetramethyleneoxy)terephthalate comprises the soft segments. Generally, for use in the present invention, these polymers contain by weight 15 to 60% of soft segments and 85–40% of hard segments. The preferred amount of soft segment is usually in the range of 20–55% by weight and the most preferred amount is in the range of 45–55%. It should be noted that within these polymers, the segments of poly(tetramethyleneoxy)terephthalate are usually derived from a corresponding glycol which generally has a number average molecular weight in the range of 600 to 3000, preferably in the range of 1500 to 2500, and most preferably in the range of 1800 to 2200.

In the following table, physical properties are listed for two potentially elastic elastomeric fibers suitable for use in the present invention. The properties are reported for these fibers before and after a 180° C., 3-minute, relaxed heat treatment. The fibers were made by melt-extruding poly(butyleneterephthalate)-co-poly(tetramethyleneoxy)terephthalate into filaments and then drawing the the filaments at a draw ratio of 2.2:1, as described in greater detail in the Example below. The polymers used were Hytrel® polyester elastomers manufactured by E. I. du Pont de Nemours and Company of Wilmington, Del. Note the large differences in tenacity, elongation and modulus that result from the heat treatment.

TABLE

| Polymer | A | | B | |
|---|---|---|---|---|
| Soft-to-Hard Segment Weight Ratio | 41/59 | | 52/48 | |
| Soft segment molecular weight | 1000 | | 2000 | |
| Tex per filament | 0.32 | | 0.27 | |
| Melting point, °C. | 208 | | 213 | |
| Heat Treated | No | Yes | No | Yes |
| Tenacity, dN/tex | 3.0 | 1.5 | 1.9 | 1.5 |
| Elongation, % | 45 | 157 | 104 | 245 |
| Modulus, dN/tex | 3.0 | 1.0 | 1.1 | 0.6 |

It should be noted that the melt-spun, potentially elastic, elastomeric filaments are usually drawn at a draw ratio of at least 2:1 to provide drawn filaments having a tenacity of at least about 1 gpd (0.9 dN/tex) and an elongation at break of less than about 125%, preferably less than 100%, so that the fibers can be handled readily on conventional batt-forming equipment.

Generally, the staple fiber blends used in the process of the present invention comprise by weight of the total blend, no less than 5% and no more than 40% of elastomeric fibers. Usually, the elastomeric fibers make up less than 30% of the blend and preferably amount to between 10 and 25%. The fraction of elastomeric fibers selected for the blend depends on the amount of elastic character desired in the final product and the elastic properties that can be developed by heat treatment of the potentially elastomeric fibers. The temperture of the heat treatment also affects the elastic properties that can be developed. The following tabulation shows the effect of the temperature of a 3-minute, relaxed heat treatment on the break elongation developed in drawn filaments of the Hytrel® polyester elastomer that was identified as "B" above.

| Temperature °C. | Elongation % |
|---|---|
| 75 | 170 |
| 100 | 200 |
| 150 | 220 |
| 180 | 245 |
| 200 | 380 |

After the fiber batt has been formed, the batt is given a hydraulic entanglement treatment in accordance with the general procedures disclosed in U.S. Pat. Nos. 3,485,706, 3,493,462, 3,494,821, 3,560,326 and more recently 4,069,563. The batt is treated while supported on a foraminous member. Generally, the support will be in the form of a woven wire screen having a mesh of 60 (i.e., 23.6 wires/cm) or less in at least one direction and an open area of at least 20%. Alternatively, an apertured plate having a corresponding number of openings and open area can be used.

The supported batt is treated by fine, columnar streams of water, preferably supplied at a gauge pressure of at least 200 psi (1379 kPa) from a row or rows of small-diameter (e.g., 0.003 to 0.007 inch [0.076–0.178 mm]) orifices evenly spaced at 10 to 60 per inch (3.9 to 23.6/cm) in each row. The fine columnar streams supply an energy flux at the web of at least 23,000 ft-poundals/in$^2$ sec (9000 Joules/cm$^2$ min) to provide a total energy of impingement of at least 0.1 Hp-hr/lb ($0.59\times10^6$ J/kg) of fabric. Usually pressures of greater than 2000 psi (13,790 kPa) are not necessary.

The weight of the web is selected with regard to the use intended for the fabric. Generally, the unit weight of the spunlaced fabric is in the range of 0.5 to 10 oz/yd$^2$ (17 to 340 g/m$^2$).

After the hydraulic treatment has formed the spunlaced fabric, the fabric is heat-treated to develop the elastic properties. It is preferred that the fabric be heat-treated in a relaxed condition. Any conventional heating device, oven, tenter, or the like, can be used for the treatment. The temperature of the heat treatment usually depends on the particular fibers in the blend. Usually the heat treatment is carried out at a temperature in the range of 100° to 200° C., for a time sufficient to develop the elastic characteristics of the potentially elastic elastomeric fibers. A preferred treatment consists of heating the fabric to a temperature of about 180° C. When the heat treatment is carried out with the fabric in a relaxed condition, significant shrinking and bulking of the fabric can occur. In addition, as a result of the above-described process, the final spunlaced and heat-treated nonwoven fabric exhibits physical and aesthetic characteristics that are suprisingly superior to those of a similarly hydraulically entangled batt that did not include the elastic fibers. In particular, the effects on the elongation, resilience and resistance to disentanglement of the fabric of the invention appear to be far in excess of and disproportionate to the small fraction of elastic fiber contained in the fabric.

The present invention also includes novel fabrics prepared by the process of the present invention. In particular, the products of the present invention comprise spunlaced fabrics that contain blends of at least two types of staple fibers; one type being conventional hard staple fibers and the other type being elastic staple fibers. Generally, the elastic staple fibers comprise more than 5% and less than 40% by weight of all the fibers, and preferably 10 to 25%. It is also preferred that the elastic staple fibers of the spunlaced fabric be of a melt-spun and drawn polymer of poly(butylene terephthalate)-co-poly-(tetramethyleneoxy)terephthalate.

The following test procedures provide data on various characteristics of the fibers used and the nonwoven fabrics produced in the practice of the present invention. Unless stated otherwise, these tests were used for obtaining the values reported herein.

Fiber tensile, elongation and modulus are measured by ASTM Method D-2653-72.

Disentanglement resistance of fabric is measured in cycles by the Alternate Extension Test (AET) described by M. M. Johns & L. A. Auspos, "The Measurement of the Resistance to Disentanglement of Spunlaced Fabrics," Symposium Papers, Technical Symposium, *Nonwoven Technology—Its Impact on the* 80's, INDA, New Orleans, La., 158–174 (March 1979).

Grab tensile strength of the fabric is reported for 1-inch (2.54-cm) wide strips of fabric. Machine direction (MD) and crossmachine direction (XD) measurements are made with an Instron machine by ASTM Method D-1682-64 with a clamping system having a 1×3 inch (2.54×7.62 cm) back face with the 2.54 cm dimension in the vertical or pulling direction) and a 1.5×1 inch (3.81×2.54 cm) front face (with the 3.81 cm dimension in the vertical or pulling direction) to provide a clamping area of 2.54×2.54 cm. A 4×6 inch (10.16×15.24 cm) sample is tested with its long direction in the pulling direction and mounting between 2 sets of clamps at a 3-inch (7.62 cm) gauge length (i.e., length of sample between clamped areas). The average of the MD and XD values are reported. Break elongation values are measured at the same time and reported in the same manner. The same size of samples and the same equipment can be used to measure the recovery properties of the fabrics.

Bending rigidity, which can be used as an indication of the liveliness or resilience of a fabric (i.e., the ability of a fabric to return to its original state after removal of a deforming force) can be measured as described by Sueo Kawabata, "The Standardization and Analysis of Hand Evaluation," 2nd Ed., The Textile Machinery Society of Japan, Osaka, Japan, 30–31 (1980).

EXAMPLE

A batch of poly(butylene terephthalate)-co-poly(tetramethyleneoxy)terephthalate polymer flake (Hytrel® 5664 polyester elastomer) was dried at 100° C. for 6 hours in a forced air oven and then fed to a single-screw melt-extruder which had three successive heating zones maintained at 192°, 235° and 245° C., respectively. The polymer was extruded through sixty-eight 0.015-inch (0.038-cm) diameter orifices having a 5:1 length-to-diameter ratio located in a spinneret maintained at 240° C. A screw pressure of 750 psi (517 kPa) and a total flow of 20.7 grams per minute was maintained. The resultant filaments were quenched by air at room temperature and a magnesium-stearate-in-silicone-oil textile finish was applied to the filaments. The filaments were withdrawn by a feed roll operating at 1000 meters per minute, then drawn at a draw ratio of 2.2:1 with a draw roll operating at 2200 meters/min and then wound up at 1900 meters/min. Between the draw and final windup rolls, the filaments were permitted to relax. Drawing and relaxation were performed at room temperature.

The 68 filaments formed a 102 denier (11.3 tex) yarn which exhibited a tenacity of 2.2 grams per denier (1.9 dN/tex), an elongation of 108% and a modulus of 1.6 gpd (1.4 dN/tex) when tested on an Instron tester at a strain rate of 250% per minute. These filaments were to form the potentially elastic, elastomeric fiber portion of the starting fiber blend. A sample of these filaments was heat-treated in a relaxed state for three minutes at 200° C. The heat-treated filaments had a tenacity of 0.8 gpd (0.7 dN/tex), an elongation of 380%, and a modulus of 0.5 gpd (0.4 dN/tex).

The as-spun and drawn filaments were creeled, formed into a 60,000 denier (6,670 tex) tow, cold stufferbox crimped and cut with a Lummus cutter into staple fibers of 1.5-inch (3.8-cm) length. These fibers were blended by hand with 3.0 dpf (0.33 tex per filament), 4½ inch (11.4-cm) long polyester fibers of 4.2 gpd (3.7 dN/tex) tenacity and 41% break elongation. The blend contained 80% by weight polyester fibers and 20% polyester elastomer fibers. This blend was then formed into a 1.5-oz/yd$^2$ (50.9-g/m$^2$) batt on a Garnett card.

Three layers of Garnett batt were then hydraulically entangled. The batts were wet with water while being supported on a 72×62 mesh (28.3 wires/cm by 24.4 wires/cm) screen and then passed beneath a bank of orifices from which streams of water emerged in the form of columnar jets having a divergence angle of less than about one degree. The orifices, which were 0.005 inch (0.013 cm) in diameter, were arranged in two staggered rows perpendicular to the length of the batt and one inch (2.5 cm) above the surface of the batt. The orifices in each row were spaced 0.05 inch (0.13 cm) apart center to center and the rows were 0.04 inch (0.10 cm) apart. Seven passes, at a speed of 26 yards/min (24 m/min) were made beneath these orifices which operated at a water pressure of 600 psi (4,130 kPa) in the first pass, 1400 psi (9,650 kPa) in the second pass and at 2000 psi (13,780 kPa) in the last five passes. The resultant spunlaced fabric was dried at 66° C. The dry fabric weighed 3.6 oz/yd$^2$ (122 g/m$^2$).

The spunlaced fabric was then heat-treated under zero tension at 180° C. for 5 minutes and then heat-set on a frame at 210° C. for two minutes. The final weight of fabric was 4.8 oz/yd$^2$ (163 g/m$^2$). The fabric exhibited desirable strength, stretch, resilience and surface characteristics.

The heat-treated, heat-set spunlaced fabric was laminated to a 19-oz/yd$^2$ (644-g/m$^2$) vinyl film by means of a Plastisol ® vinyl adhesive. A laboratory press, operating at a temperature of 165.5° C. and a pressure of 5 psi (35 kPa) for one minute, was used for the lamination. A control spunlaced fabric composed 100% of polyester staple fibers and weighing 5 oz/yd$^2$ (170 g/m$^2$) [Sontara ® Type 062 manufactured by E. I. du Pont de Nemours and Company] was laminated in the same manner.

The thusly prepared laminated fabrics were tested for stretch and recovery. A three-inch (7.6-cm) wide strip of each coated fabric was subjected to a load of 27 pounds (12.3 kg) for 30 minutes; the load was then removed; and the fabric was maintained under no load for another 30 minutes. The length of the fabric was measured before loading, under load and 30 minutes after removal of the load. The following data were derived:

| | Sample of Invention | Control Sample |
|---|---|---|
| Total Unit Weight | | |
| Oz/yd$^2$ | 23.8 | 23.0 |
| (g/m$^2$) | (807) | (780) |
| Machine Direction Stretch, % | 24 | 5.4 |
| % Recovery from Stretch | 97.4 | 99.0 |

The laminated fabric of the invention, with its 24% stretch, its greater-than-95% recovery and its excellent conformability, was judged to be well suited for vinyl-coated upholstery. In contrast, the lack of adequate stretch and conformability in the control sample made the control completely unsuited for use in such upholstery.

What is claimed is:

1. In a process for making a spunlaced nonwoven fabric, wherein a batt composed of at least two types of staple fibers is subjected to hydraulic entanglement, the improvement comprising, for imparting greater stretch and resilience to the fabric, forming the batt of hard fibers and potentially elastic, elastomeric fibers and after the hydraulic entanglement treatment, heat-treating the resultant spunlaced fabric to develop elastic characteristics in the elastomeric fibers.

2. A process of claim 1 wherein the elastomeric fibers comprise between 10 and 25% by weight of the batt.

3. A process of claim 1 wherein the elastomeric fibers are of a melt-spun and drawn poly(butylene terephthalate)-co-poly-(tetramethyleneoxy)terephthalate polymer.

4. A process of claim 3 wherein poly(butylene terephthalate) units amount to 15 to 60% and poly(tetramethyleneoxy)terephthalate units amount to 85 to 40% by weight of the polymer.

5. A process of claim 4 wherein the poly(butylene terephthalate) units amount to 45 to 55% by weight of the polymer and the poly(tetramethyleneoxy)terephthalate units are derived from a corresponding glycol having a number average molecular weight in the range of 1800 to 2200.

6. An improved spunlaced nonwoven fabric composed of a blend of at least two different types of staple fibers, wherein the improvement comprises the fabric containing no more than 40% and no less than 5% by weight elastomeric staple fibers that become elastic after being subjected to a heat treatment.

7. An improved spunlaced nonwoven fabric composed of a blend of at least two different types of staple fibers, the improvement comprising no more than 40% and no less than 5% by weight of elastomeric staple fibers that are elastic.

8. A spunlaced fabric of claim 6 or 7 wherein the elastomeric staple fibers are of poly(butylene terephthalate)-co-poly-(tetramethyleneoxy)terephthalate polymer in which the poly(butylene terephthalate) units amount to 45 to 55% and the poly(tetramethylene oxy)-terephthalate units amount to 55 to 45 percent by weight of the polymer and the poly(tetramethylene oxy) terephthalate units are derived from a corresponding glycol having a number average molecular weight in the range of 1800 to 2200.

* * * * *